United States Patent [19]

Kurosaki

[11] Patent Number: 4,873,910

[45] Date of Patent: Oct. 17, 1989

[54] DRUM FOOT PEDAL APPARATUS

[75] Inventor: Makoto Kurosaki, Hamamatsu, Japan

[73] Assignee: Yamaha Corporation, Hamamatsu, Japan

[21] Appl. No.: 319,684

[22] Filed: Mar. 7, 1989

[30] Foreign Application Priority Data

Mar. 8, 1988 [JP] Japan ..... 63-29877

[51] Int. Cl.[4] ..... G10D 13/02

[52] U.S. Cl. ..... 84/422.1

[58] Field of Search ..... 84/422.1, 422.2, 422.3

[56] References Cited

U.S. PATENT DOCUMENTS 833,706 10/1906 Conn ..... 84/422.2
3,439,574 4/1969 Ramsey ..... 84/422.1
4,756,224 7/1988 Lombardi ..... 84/422.1

FOREIGN PATENT DOCUMENTS 53-13127 2/1978 Japan .

*Primary Examiner*—Lawrence R. Franklin
*Attorney, Agent, or Firm*—Burns, Doane, Swecker & Mathis

[57] ABSTRACT

A drum foot pedal apparatus includes a stabilizing plate, springs, fixing metal pieces, fastening bolts, and pawls. The pawls prevent a frame from being removed from the stabilizing plate. The fastening bolts are threadably engaged with screw holes of the frame through U-shaped grooves of screw mounting portions, the springs, and the fixing metal pieces, respectively. Thus, there is provided a drum foot pedal apparatus which is easy to handle and has a simple structure in which a frame and a heel can be stably fixed.

5 Claims, 3 Drawing Sheets

DRUM FOOT PEDAL APPARATUS

BACKGROUND OF THE INVENTION

The present invention relates to a drum foot pedal apparatus in which a frame and a heel can be firmly fixed to improve stability during a performance.

In a conventional bass drum foot pedal apparatus, a beater is pivoted to strike a drum head upon depression of a foot board. A typical conventional bass drum foot pedal apparatus has a structure shown in FIG. 5. A foot pedal apparatus 1 comprises a substantially C-shaped base 2*a* placed on a floor surface, and a pedal frame (to be referred to as a frame hereinafter) 2 consisting of a pair of right and left columns 2*b* and 2*c*. A pivot shaft 3 is pivotally supported between upper end portions of the right and left columns 2*b* and 2*c*. A rim of a bass drum (not shown) is fixed to the base 2*a* by a hoop clamp 13. A rocker 4 is fixed on the pivot shaft 3. A beater 6 is mounted on the rocker 4 through a beater rod 5. A front end 8*a* of a foot board 8 is connected to the rocker 4 through a belt 7. The front end 8*a* of the foot board 8 is biased upward by a return spring 12 for applying a pivotal force to the pivot shaft 3 in a return direction. Therefore, the foot board is normally held to be inclined at a predetermined angle, as shown in FIG. 5. A front end 8*b* of the foot board 8 is pivotally connected to a heel 9. The heel 9 is connected to the frame 2 through a connecting rod 10. The return spring 12 is disposed along an outer side surface of one column 2*c* of the frame 2. The upper end of the return spring 12 is connected to an end of the pivot shaft 3 through a cam plate 11, and the lower end of the return spring 12 is locked by the column 2*c*.

Upon depression of the foot board 8, the belt 7 is pulled downward, and the rocker 4 is pivoted together with the pivot shaft 3 against the return spring 12 in a direction indicated by an arrow A. Therefore, the beater 6 strikes the drum head.

In a conventional drum foot pedal apparatus 1 of this type, the frame 2 is connected to the heel 9 through the connecting rod 10. The connecting rod 10 has a spring property. The rear end of the connecting rod 10 is detachably inserted in a through hole 14 formed in the frame 2. In a connecting structure of the frame 2 and the heel 9 through the connecting rod 10, the connecting rod 10 tends to clutter in the through hole 14. In addition, since the drum foot pedal apparatus 1 itself is lightweight, the foot board 8 and the heel 9 tend to float during a performance, thus posing a problem on stability.

Another conventional drum foot pedal apparatus is proposed to solve the above problem. In this apparatus, a stabilizing plate is disposed under the drum foot pedal apparatus 1, and the connecting rod 10 is clamped between the stabilizing plate and a mounting plate screwed on the stabilizing plate. According to this method, since only part of the connecting rod 10 is clamped, stability of the drum foot pedal apparatus 1 is insufficient. During a performance requiring frequent depression of the foot board, the drum foot pedal apparatus clutters. In addition, when the mounting plate is removed from the stabilizing plate, the components are separated from each other and may be lost.

SUMMARY OF THE INVENTION

It is a principal object of the present invention to provide a drum foot pedal apparatus having a simple structure in which a frame and a heel can be stably fixed.

It is another object of the present invention to provide a drum foot pedal apparatus which is easy to handle when the apparatus is detached from a stabilizing plate since components are not separated from each other.

In order to achieve the above objects of the present invention, there is provided a drum foot pedal apparatus comprising a beater for striking a drum, a frame for pivotally supporting a pivot shaft of the beater at both ends thereof, a foot pedal, a front end of which is connected to the pivot shaft of the beater through a belt and a rear end of which is pivotally connected to a heel, a flat stabilizing plate disposed under the heel, the foot pedal, and the frame, the frame being provided with screw holes at both side surfaces of a lower end portion of the frame, the stabilizing plate being provided with screw mounting portions having upward open U-shaped grooves respectively corresponding to the screw holes of the frame, the screw mounting portions being located on a frame side, springs, fixing metal pieces, fastening bolts, and means for preventing the frame from being separated from the stabilizing plate, the fastening bolts being threadably engaged with the screw holes of the frame through the U-shaped grooves of the screw mounting portions, the springs, and the fixing metal pieces, respectively.

According to the present invention, the frame and heel are fixed on the stabilizing plate, and the fixing metal pieces are not removed from the fastening bolts unless the fastening bolts are removed from the frame.

DESCRIPTION OF THE PREFERRED EMBODIMENTS

Preferred embodiments of the present invention will be described with reference to the accompanying drawings.

Figure 3:
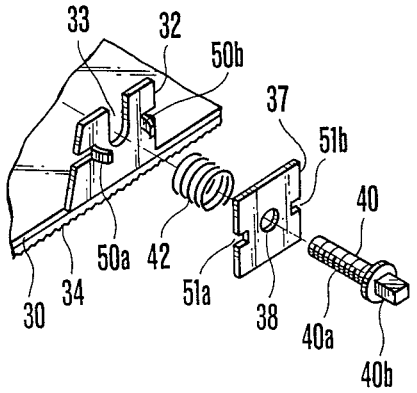
FIGS. 3 and 4 are exploded perspective views showing main parts of a drum foot pedal apparatus according to another embodiment of the present invention.
Figure 4:
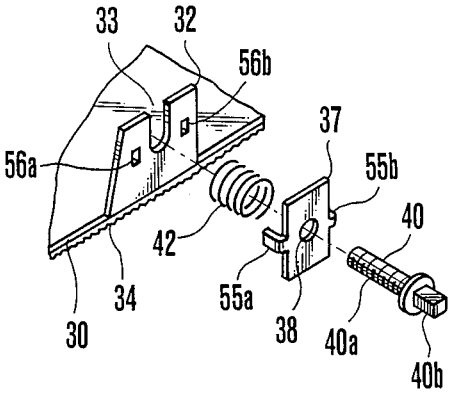
Figure 5:
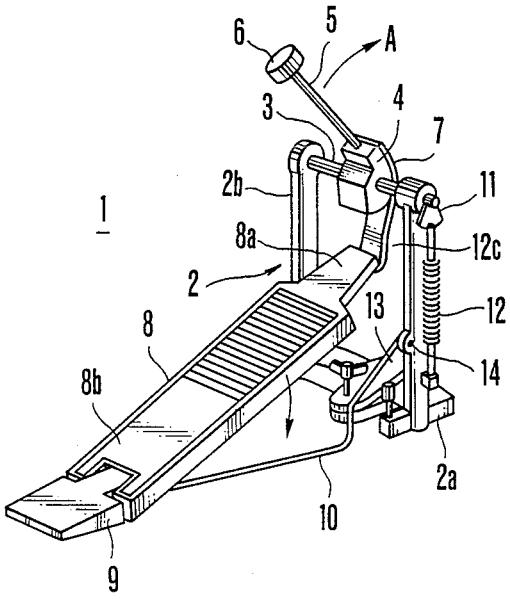
FIG.5 (PRIOR ART)
FIG. 5 is a perspective view showing a conventional drum foot pedal apparatus.

The same reference numerals as in the conventional drum foot pedal apparatus in FIG. 5 denote the same parts in FIGS. 1 to 4, and a detailed description thereof will be omitted.

Figure 1:
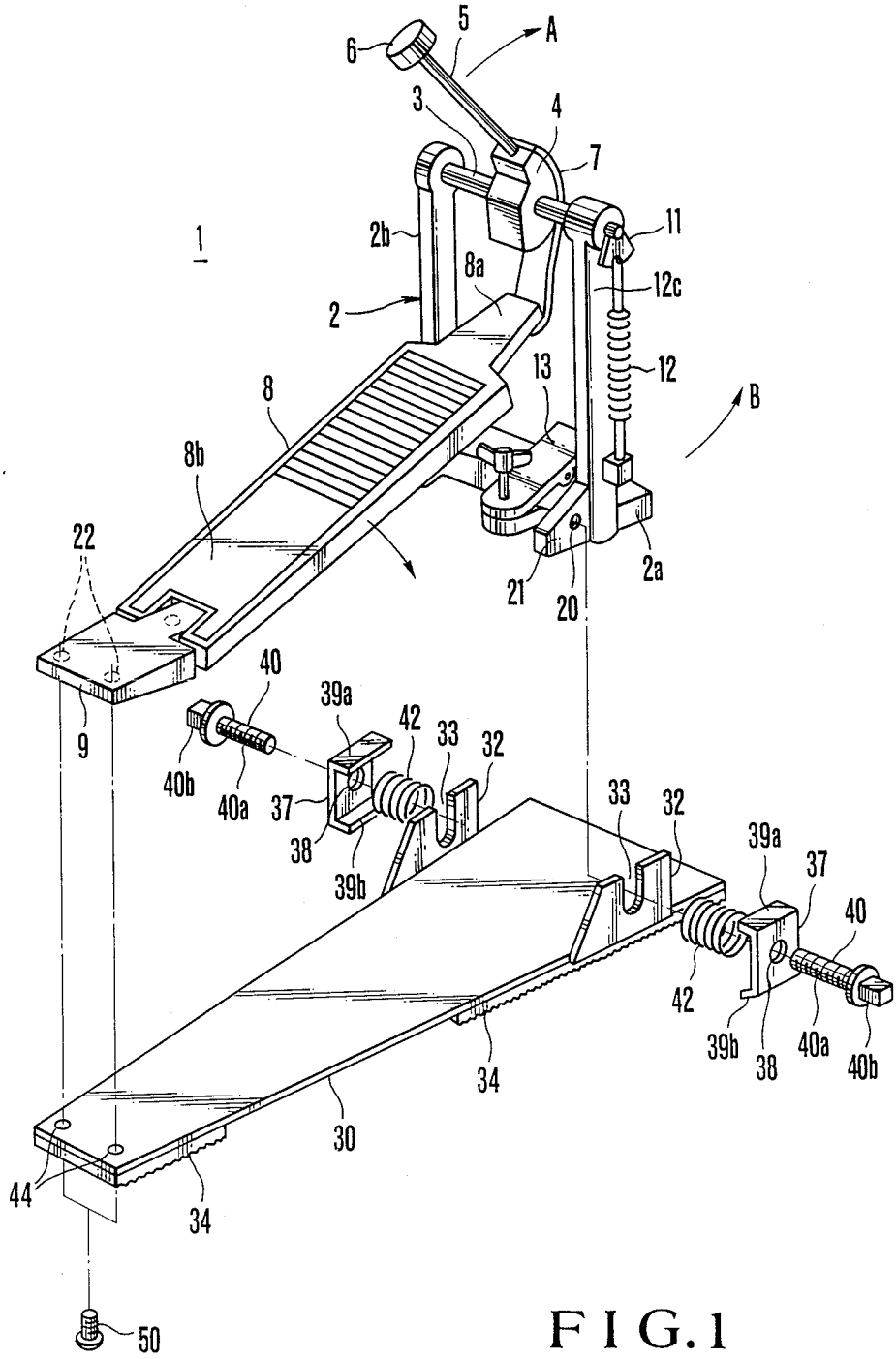
FIG. 1 is an exploded perspective view showing a drum foot pedal apparatus according to an embodiment of the present invention.
Figure 2:
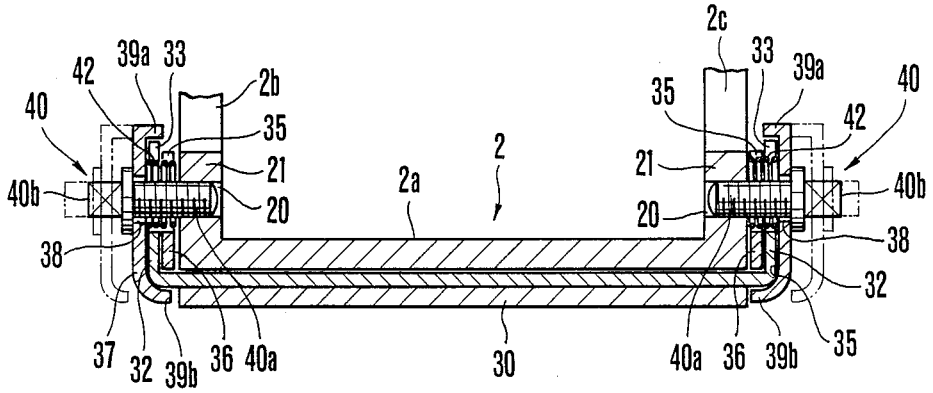
FIG. 2 is a sectional view showing a main part of the drum foot pedal apparatus.

FIGS. 1 and 2 show a drum foot pedal apparatus according to an embodiment of the present invention. Referring to FIGS. 1 and 2, a connecting rod for stabilizing a drum foot pedal apparatus 1 is replaced with a stabilizing plate 30 detachably mounted on the bottom surface of the drum foot pedal apparatus 1. Fixing portions 21 having screw holes 20 are formed integrally with both side surfaces of a base 2*a* of a frame 2. A plurality of screw holes, e.g., two screw holes 22 are formed in the lower surface of a heel 9.

The stabilizing plate 30 has a flat shape extending in the front-to-rear direction. A pair of right and left bolt mounting portions 32 which are bent to extend upward are formed at both sides of the front end portions. The bolt mounting portions 32 correspond to the fixing portions 21 of the frame 2, respectively. U-shaped grooves 33 are formed at upper end faces of the bolt mounting portions 32, respectively. Spacers 36 having U-shaped grooves 35 are fixed in tight contact with the inner surfaces of the bolt mounting portions 32, respectively. Rubber nonskid plates 34 are respectively adhered to the lower surface portions of the front and rear end portions of the stabilizing plate 30 to prevent slippage of the stabilizing plate 30 along a floor surface.

Reference numerals 37 denote fixing metal pieces which can be tightly engaged with the outer surfaces of the bolt mounting portions 32, respectively. Each fixing metal piece 37 is made of a metal plate, and insertion holes 38 which can be engaged with male threads 40*a* of fastening bolts 40 are formed at the central portions of the metal pieces 37, respectively. Pawls 39*a* and 39*b* bent inward are formed integrally with the predetermined upper and lower end positions of each fixing metal piece 37 which can be engaged with the upper and lower ends of the corresponding bolt mounting portion 32. The fastening bolts 40 movably hold the fixing metal pieces. The distal ends of the male threads 40*a* are threadably engaged with the screw holes 20 of the frame 2, respectively. In this case, the head of each fastening bolt 40 has basically the same shape and size as those of a fastening bolt for connecting a drum rim and a lug. Therefore, the bolt 40 can be fastened by a drum tuning key for fastening the fastening bolt for connecting the drum rim and the lug. Compression coil springs 42 are mounted on the male threads 40*a* of the fastening bolts 40 to urge the fixing metal pieces 37 against heads 40*b* of the bolts 40 and to facilitate insertion of the bolt mounting portions 32, respectively.

A pair of right and left screw mounting holes 44 corresponding to the screw holes 22 of the heel 9 are formed in the rear end portions of the stabilizing plate 30.

In the drum foot pedal apparatus 1 having the above structure, in order to fix the stabilizing plate 30 to the foot pedal 1, the frame 2 and heel 9 are placed on the stabilizing plate 30 such that the screw holes 20 and the U-shaped grooves 33 respectively correspond to the screw holes 22 and the screw mounting holes 44. In this state, the fastening bolts 40 are respectively inserted in the U-shaped grooves 33, and the fixing metal pieces 37 are biased by the compression coil springs 42 and are separated from the bolt mounting portions 32, as indicated by the alternate long and two short dashed lines in FIG. 2. When the fastening bolts 40 are fastened by the drum tuning key, the fixing metal pieces 37 are moved inward by the heads 40*b* of the bolts 40 against the compression coil springs 42 and are brought into tight contact with the outer surfaces of the bolt mounting portions 32, respectively, thereby connecting the frame 2 and the stabilizing plate 30. In other words, the pair of right and left fixing metal pieces 37 clamp the pair of right and left bolt mounting portions 32 upon fastening with the fastening bolts 40, thereby fixing the frame 2 to the stabilizing plate 30.

The heel 9 is fixed on the rear end portion of the upper surface of the stabilizing plate 30 by set screws 50 inserted into the screw mounting holes 44 and threadably engaged with the screw holes 22.

In the drum foot pedal apparatus 1 having the above structure, since the front and rear portions of the foot pedal apparatus, that is, the frame and the heel 9 thereof, are fixed on the stabilizing plate 30, stability of the drum foot pedal apparatus 1 can be improved to prevent cluttering of the pedal apparatus 1 in the front-to-rear and right-to-left directions during a performance. In addition, the bent pawls 39*a* and 39*b* corresponding to the upper and lower positions of the bolt mounting portions 32 are formed at the upper and lower ends of the fixing metal pieces 38, so that the bent pawls 39*a* and 39*b* are engaged with the upper and lower portions of the bolt mounting portions. Therefore, the frame 2 and the stabilizing plate 30 are not vertically offset or removed from each other. An operation for attaching the drum foot pedal apparatus 1 to the stabilizing plate or detaching the apparatus 1 from the stabilizing plate can be performed using the drum tuning key, and an additional tool is not required. In addition, the fixing metal pieces 37 and the compression coil springs 42 are not removed from the fastening bolts 40 unless the fastening bolts 40 are removed from the screw holes 20 of the frame 2. Therefore, the components will not be lost.

With the above structure, when the drum foot pedal apparatus 1 is not used, the fastening bolts 40 are loosened, and the bolts 40, the fixing metal pieces 37, and the springs 42 are removed from the bolt mounting portions 32 fixed on the stabilizing plate 30. The overall structure can be folded to a compact structure. That is, the fixing portions 21 of the frame 2 are pivoted in a direction of an arrow B to be placed on the foot board 8, and the overall structure can be made compact. As a result, the drum foot pedal apparatus can be easily carried as in the conventional drum foot pedal apparatus.

In the above embodiment, the compression coil springs 42 for biasing the fixing metal pieces 37 outward against the fastening bolts 40, and an insertion operation of the bolt mounting portions 32 in the stabilizing plate 30 is facilitated. However, the coil springs 42 may be omitted. In addition, the heel 9 is fixed by the screws 50. However, other engaging means such as a hook may be used.

The pawls 39*a* and 39*b* of each fixing metal piece 37 may have a structure shown in FIG. 3 or 4.

FIG. 3 shows a structure in which parts of both side surfaces of each bolt mounting portion 32 are partially punched and bent in the front-to-rear direction to form pawls 50*a* and 50*b*, and recesses 51*a* and 51*b* which can engage with the pawls 50*a* and 50*b* are formed in the corresponding fixing metal piece 37. With this structure, vertical removal between the frame 2 and the stabilizing plate 30 can be prevented in the same manner as in the pawls 39*a* and 39*b* in the above embodiment. A removal preventing structure for the stabilizing plate and the frame may be provided to one side of the frame.

FIG. 4 shows a structure wherein pawls 55*a* and 55*b* obtained by partially punching parts of both side surfaces of each fixing metal piece 37 in the front-to-rear direction are formed, and holes 56*a* and 56*b* which engage with the pawls 55*a* and 55*b* are formed in the corresponding bolt mounting portion 32, unlike in the structure of FIG. 3. This structure has the same effect as in FIG. 3.

In addition, referring to FIGS. 1 and 2, the pawl 39*a* may be omitted, and the same effectws as in the above embodiment, i.e., prevention of vertical removal of the frame 2 from the stabilizing plate 30, can be expected by only the pawl 39*b*.

In the drum foot pedal apparatus according to the present invention as has been described above, since the frame and the heel are fixed on the upper surface of the stabilizing plate, the drum foot pedal apparatus can be stabilized and firmly fixed to prevent cluttering in the vertical and horizontal directions. The fixing metal pieces mounted on the frame through the fastening bolts are brought into tight contact with the bolt mounting portions of the stabilizing plate upon fastening of the fastening bolts. Therefore, attachment or detachment of the frame to or from the stabilizing plate can be facilitated. The fixing plate is not removed from the bolts unless the bolts are removed from the frame, and these components are not separated from each other or lost, thus providing a great practical effect.

What is claimed is:

1. A drum foot pedal apparatus comprising:

a beater for striking a drum;

a frame for pivotally supporting a pivot shaft of said beater at both ends thereof;

a foot pedal, a front end of which is connected to said pivot shaft of said beater through a belt and a rear end of which is pivotally connected to a heel; and a flat stabilizing plate disposed under said heel, said foot pedal, and said frame, said frame being provided with screw holes at both side surfaces of a lower end portion of said frame, said stabilizing plate being provided with screw mounting portions having upward open U-shaped grooves respectively corresponding to said screw holes of said frame, said screw mounting portions being located on a frame side;

springs fixing metal pieces;

fastening bolts; and means for preventing said frame from being separated from said stabilizing plate, said fastening bolts being threadably engaged with said screw holes of said frame through said U-shaped grooves of said screw mounting portions, said springs, and said fixing metal pieces, respectively.

2. A drum foot pedal apparatus according to claim 1, wherein said preventing means comprises a pawl formed at a lower end of at least one of said fixing metal pieces, said pawl extending to a rear side of said stabilizing plate.

3. A drum foot pedal apparatus according to claim 1, wherein said preventing means comprises pawls formed at upper and lower ends of at least one of said fixing metal pieces to clamp a corresponding one of said screw mounting portion.

4. A drum foot pedal apparatus according to claim 1, wherein said preventing means comprises:

a projection extending to oppose said fixing metal piece of at least one of said bolt mounting portions; and a portion for locking said projection formed on said fixing metal piece.

5. A drum foot pedal apparatus according to claim 1, wherein said preventing means comprises:

a projection extending to oppose said bolt mounting portion of at least one of said fixing metal pieces; and a portion for locking said projection formed on said bolt mounting portion.

* * * * *